US009799977B1

(12) United States Patent
Chiu et al.

(10) Patent No.: US 9,799,977 B1
(45) Date of Patent: Oct. 24, 2017

(54) ELECTRICAL CONNECTOR AND ELECTRICAL CONNECTOR ASSEMBLY

(71) Applicant: GT CONTACT CO., LTD., New Taipei (TW)

(72) Inventors: Jui-Jung Chiu, Taoyuan County (TW); Chih-Cheng Tsai, New Taipei (TW)

(73) Assignee: GT CONTACT CO., LTD., New Taipei (TW)

( * ) Notice: Subject to any disclaimer, the term of this patent is extended or adjusted under 35 U.S.C. 154(b) by 0 days.

(21) Appl. No.: 15/295,716

(22) Filed: Oct. 17, 2016

(30) Foreign Application Priority Data

May 20, 2016 (TW) ..... 105207462 U

(51) Int. Cl.
*H01R 13/24* (2006.01)
*H01R 13/20* (2006.01)
*H01R 13/50* (2006.01)
*H01R 13/62* (2006.01)

(52) U.S. Cl.
CPC ..... *H01R 13/20* (2013.01); *H01R 13/2471* (2013.01); *H01R 13/50* (2013.01); *H01R 13/6205* (2013.01)

(58) Field of Classification Search
CPC ..... H01R 13/20
USPC ..... 439/38, 39, 40, 700
See application file for complete search history.

(56) References Cited

U.S. PATENT DOCUMENTS 1,765,793 A * 6/1930 Hersee ..... H01R 33/46 439/700
1,770,667 A * 7/1930 Hersee ..... H01R 33/46 439/700
4,892,491 A * 1/1990 Budano, II ..... H01R 24/44 439/578
5,590,229 A * 12/1996 Goldman ..... G02B 6/3869 385/59
6,146,168 A * 11/2000 Ishii ..... H01R 13/7031 439/188
6,699,054 B1 * 3/2004 Critelli ..... H01R 13/6315 439/248
7,607,929 B1 * 10/2009 Nguyen ..... H01R 13/6315 439/246

(Continued)

*Primary Examiner* — Tulsidas C Patel
*Assistant Examiner* — Peter G Leigh
(74) *Attorney, Agent, or Firm* — Li & Cai Intellectual Property (USA) Office

(57) ABSTRACT

An electrical connector includes an insulation kit having an accommodating groove and a separation portion disposed in the accommodating groove, and the separation portion having a penetration hole penetrating the insulation kit; a conductive assembly sheathing the separation portion and disposed in the accommodating groove, and having a conductive kit and a conductive retainer and a flexible member disposed in the conductive kit; and an electrical conductive member disposed in the penetration hole of which one end is exposed outside one end of the conductive retainer. When a part of the conductive retainer which is exposed outside the conductive kit is electrically connected to another electrical connector, the conductive retainer is compressed to compress the flexible member to enable the flexible member to produce a restoring force, and then the conductive retainer is electrically connected to another electrical connector more stably through the restoring force.

10 Claims, 13 Drawing Sheets

(56) References Cited

U.S. PATENT DOCUMENTS

| | | | | |
|---|---|---|---|---|
| 7,625,247 | B1 * | 12/2009 | Mahoney | H01R 9/0527 439/63 |
| 7,682,206 | B2 * | 3/2010 | Kainz | H01R 13/187 439/700 |
| 7,699,634 | B2 * | 4/2010 | Kholodenko | H05B 3/06 439/278 |
| 7,699,666 | B2 * | 4/2010 | Hohne | H01H 1/385 439/700 |
| 7,922,529 | B1 * | 4/2011 | Meurer | H01R 13/2421 439/248 |
| 8,043,118 | B1 * | 10/2011 | Lee | H01R 13/14 439/578 |
| 2015/0038009 | A1 * | 2/2015 | Gibson | H01R 13/6581 439/578 |

* cited by examiner

ELECTRICAL CONNECTOR AND ELECTRICAL CONNECTOR ASSEMBLY

BACKGROUND

1. Technical Field

The present disclosure relates to an electrical connector and an electrical connector assembly, in particular, to an electrical connector and an electrical connector assembly used to perform a stable electrical connection.

2. Description of Related Art

For the sake of increasing the connection strength between a free end electrical connector and a fixed end electrical connector, the conventional method is to connect two electrical connectors by using the corresponding structures respectively disposed thereon. In this case, two electrical connectors can be connected to each other stably, but it cannot ensure whether two electrical connectors have an optimal electrical connection. Thus, an electrical connector and an electrical connector assembly of the present disclosure are provided to resolve the technical problem mentioned above.

SUMMARY

The primary purpose of the present disclosure is to provide an electrical connector and an electrical connector assembly to resolve the technical problem of two connectors incapable of having a stable electrical connection by using the related structures respectively disposed thereon.

According to one exemplary embodiment of the present disclosure provides an electrical connector including an insulation kit, a conductive assembly and an electrical conductive member. Two ends of the insulation kit are respectively defined as a plug end and a wire end, an accommodating groove is formed in the plug end of the insulation kit, the insulation kit has a separation portion disposed in the accommodating groove, and the separation portion has a penetration hole penetrating the insulation kit. The conductive assembly includes a conductive kit, a conductive retainer and a flexible member, wherein the conductive kit is a hollow structure and two ends of the conductive kit are respectively disposed with a limiting part, the conductive retainer and the flexible member are disposed in the conductive kit, a positioning structure of the conductive retainer abuts against one of the limiting parts, a part of the conductive retainer is selectively exposed outside the conductive kit, and two ends of the flexible member respectively abut against the other of the limiting parts and the positioning structure, wherein the conductive assembly sheathes the insulation kit, the separation portion is disposed to respectively penetrate the conductive kit, the flexible member and the conductive retainer, and the conductive retainer is exposed outside the plug end. The electrical conductive member is disposed in the penetration hole, and one end of the electrical conductive member is exposed outside the plug end. When a part of the conductive retainer which is exposed outside the plug end is compressed, the positioning structure of the conductive retainer compresses the flexible member to enable the flexible member to produce a restoring force, and the restoring force is applied to the conductive retainer.

In order to achieve the purpose mentioned above, the present disclosure provides an electrical connector assembly including a free end electrical connector and a fixed end electrical connector. The free end electrical connector includes an insulation kit, a conductive assembly and an electrical conductive member. Two ends of the insulation kit are respectively defined as a plug end and a wire end, an accommodating groove is formed in the plug end of the insulation kit, the insulation kit has a separation portion disposed in the accommodating groove, and the separation portion is disposed with a penetration hole penetrating the insulation kit. The conductive assembly includes a conductive kit, a conductive retainer and a flexible member, wherein the conductive member is a hollow structure and two ends of the conductive member are respectively disposed with a limiting part, the conductive retainer and the flexible member are disposed in the conductive kit, a positioning structure of the conductive retainer abuts against one of the limiting parts, at least one part of the conductive retainer is selectively exposed outside the conductive kit, two ends of the flexible member respectively abut against the other of the limiting parts and the positioning structure, wherein the conductive assembly sheathes the insulation kit, the separation portion is disposed to respectively penetrate the conductive kit, the flexible member and the conductive retainer, and the conductive retainer is exposed outside the plug end. The electrical conductive member is disposed in the penetration hole, and one end of the electrical conductive member is exposed outside the plug end.

The fixed end electrical connector includes a hollow insulation member, a conductive sleeving portion and an electrical connection piece. Two ends of the hollow insulation member are respectively defined as a connection end and a fixed end, an accommodating space is formed in the hollow insulation member, the hollow insulation member has a separation structure disposed in the accommodating space, and the separation structure has a through hole penetrating the hollow insulation member. The conductive sleeving portion sheathes the separation structure, and at least one part of the conductive sleeving portion is exposed outside the connection end. The electrical connection piece is disposed in the through hole, and at least one part of the electrical connection piece is exposed outside the connection end. When the free end electrical connector and the fixed end electrical connector are electrically connected to each other, the conductive retainer abuts against the conductive sleeving portion, the electrical conductive member abuts against the electrical connection piece, and the positioning structure of the conductive retainer compresses the flexible member to enable the flexible member to produce a restoring force, and then the restoring force is applied to the conductive retainer so as to enable the conductive retainer to electrically connect to the conductive kit more stably.

To sum up, by using the flexible member and the conductive retainer provided by the present disclosure, the electrical connection strength between two electrical connectors can be effectively increased.

In order to further understand the techniques, means and effects of the present disclosure, the following detailed descriptions and appended drawings are hereby referred to, such that, and through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
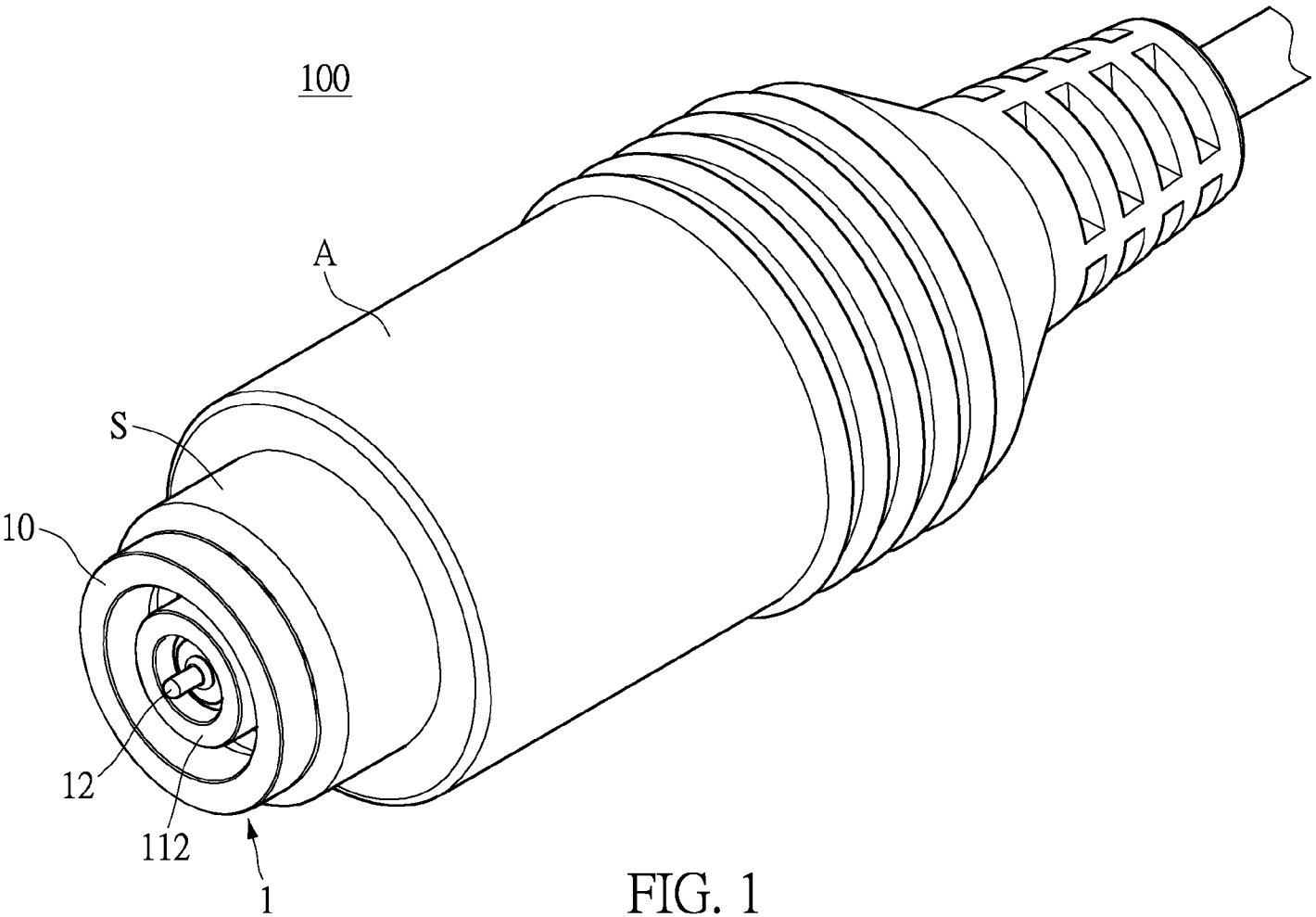
FIG. 1 is a three-dimensional schematic diagram of the electrical connector of the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

The First Embodiment

Figure 2:
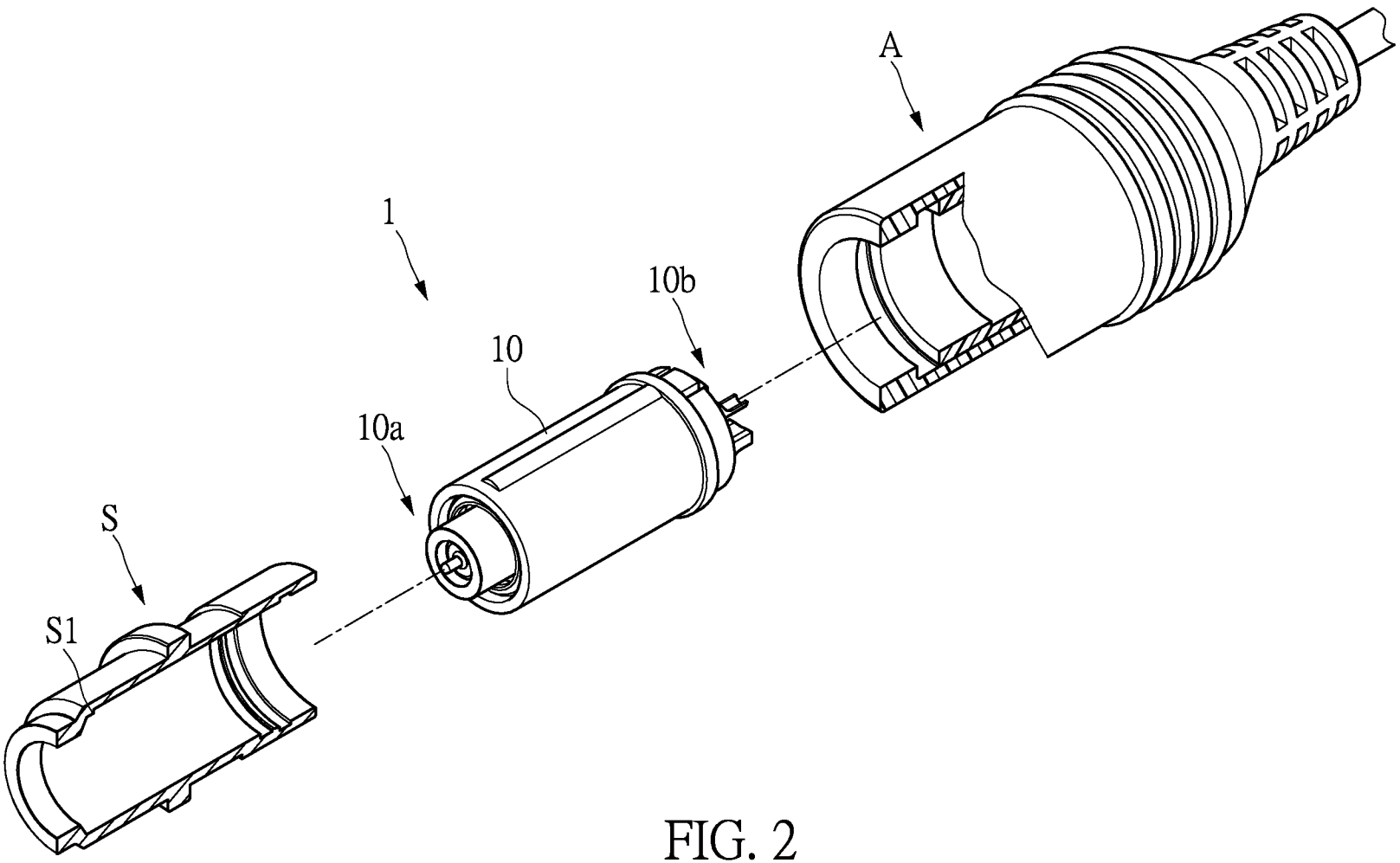
FIG. 2 is an exploded view of a part of the electrical connector of the present disclosure.

Please refer to FIG. 1 and FIG. 2 which are respectively a three-dimensional schematic diagram and of the electrical connector of the present disclosure and an exploded view of a part of the electrical connector of the present disclosure. As shown in the figures, an electrical connector 100 includes an electrical conductive assembly 1, a housing S and an insulation assembly A. The housing S is disposed at an external portion of the electrical conductive assembly 1, and the insulation assembly A covers an external side of the housing S. The electrical conductive assembly 1 is used to transmit electrical signals, and the housing S and the insulation assembly A are used to protect the electrical conductive assembly 1.

Figure 3:
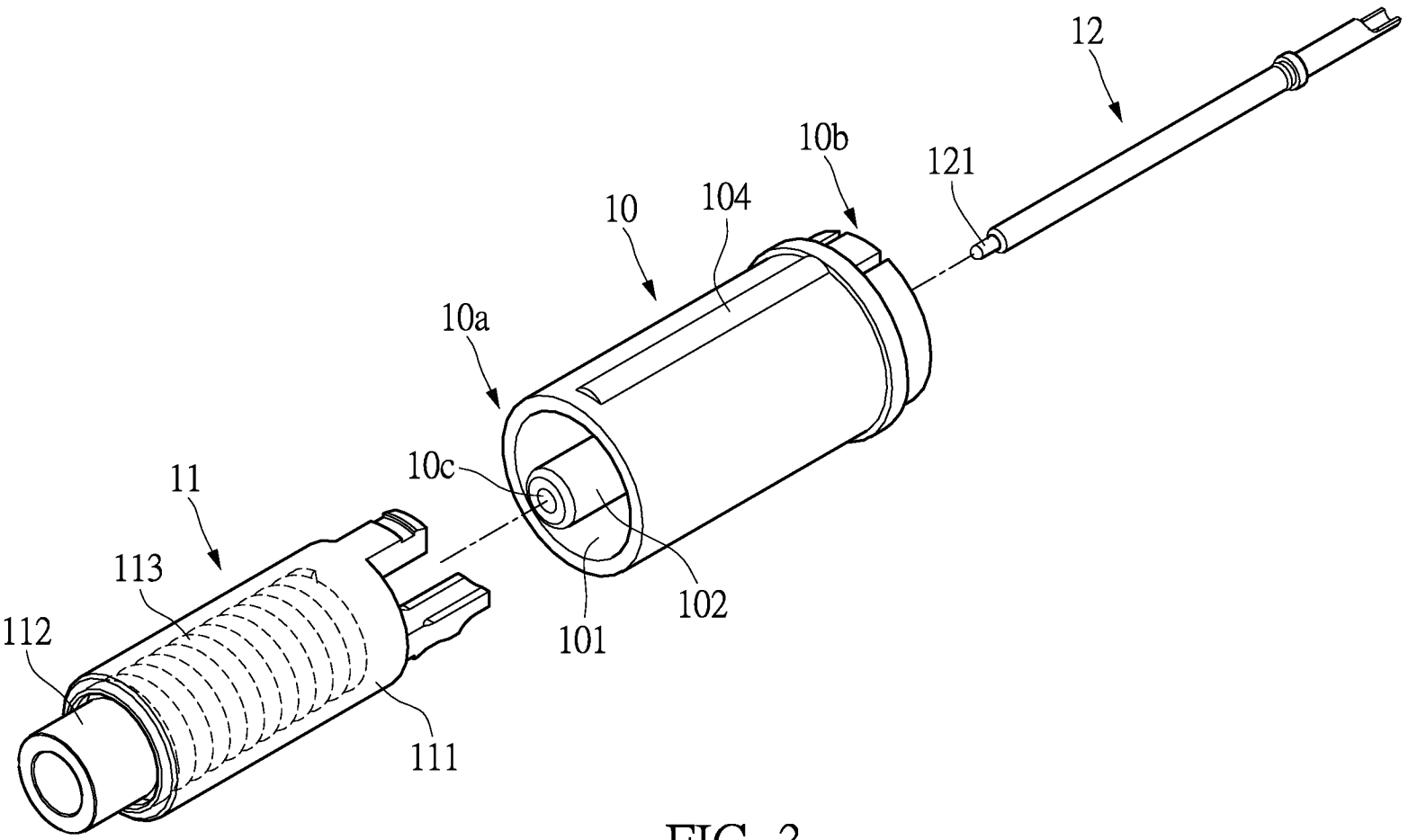
FIG. 3 is an exploded view of the conductive assembly and the electrical conductive member of the electrical connector of the present disclosure.
Figure 4:
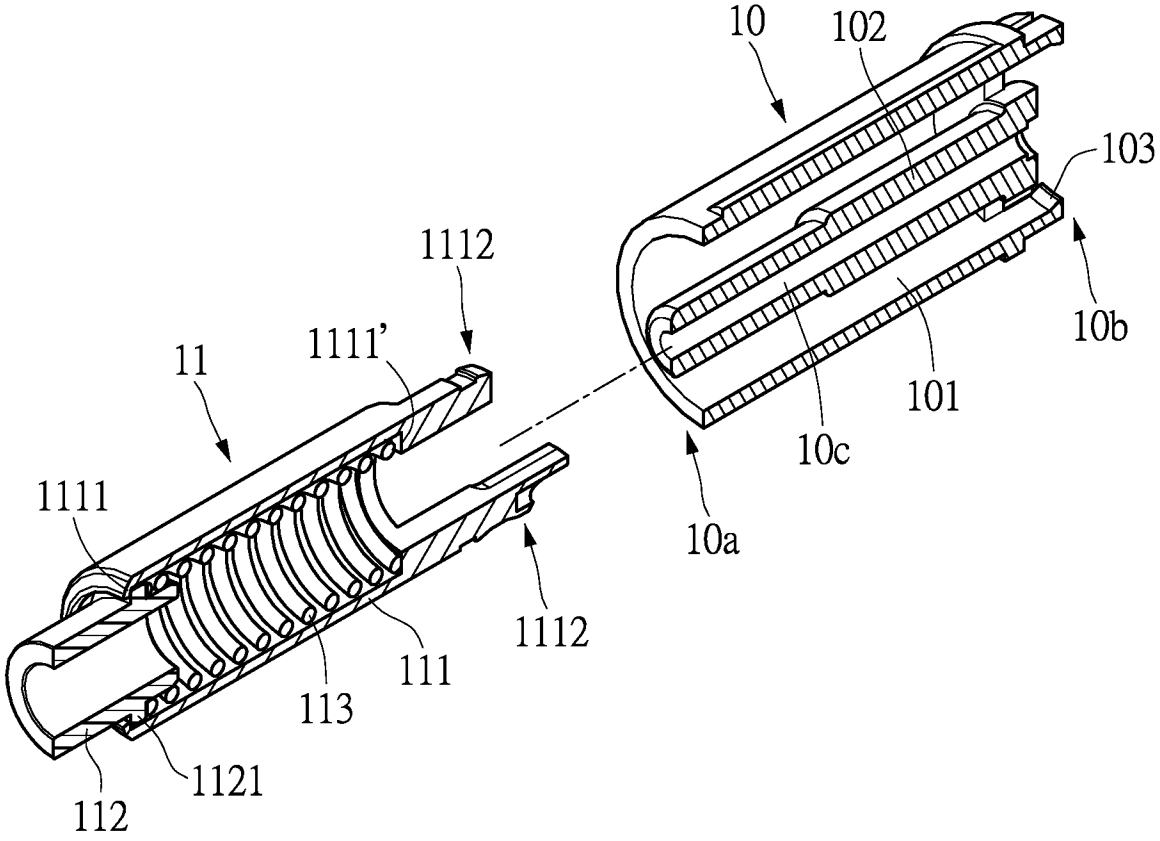
FIG. 4 is a sectional view of the conductive assembly of the electrical connector of the present disclosure.
Figure 5:
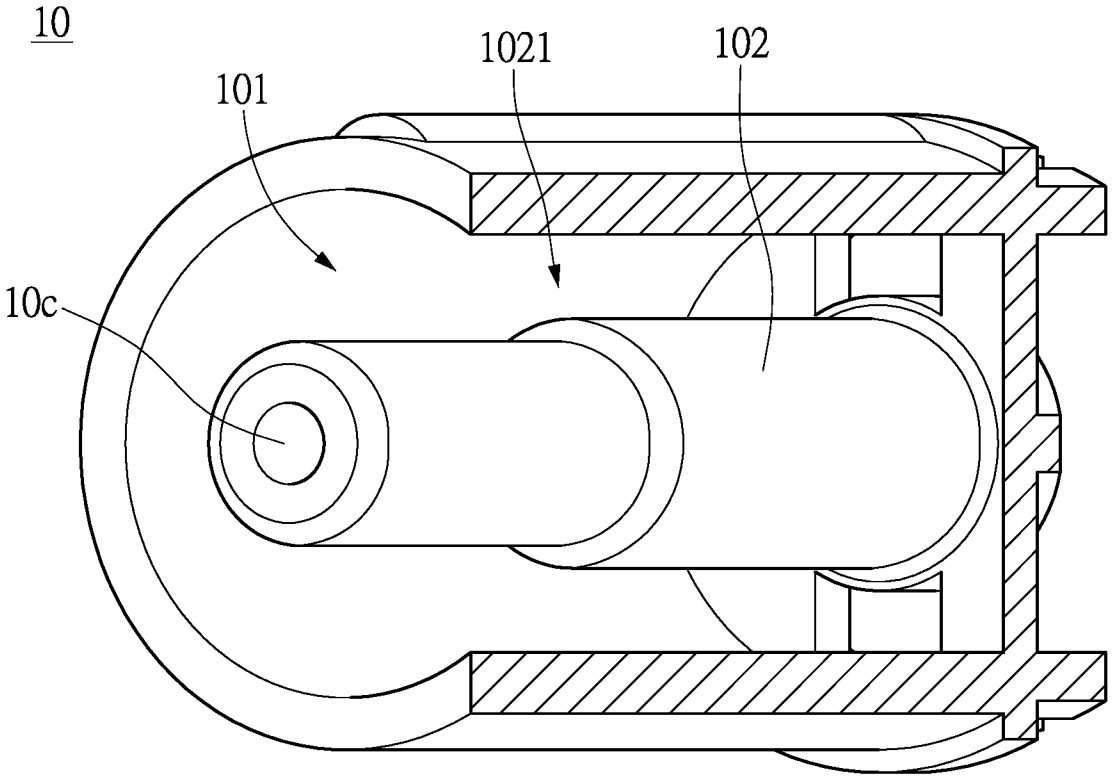
FIG. 5 is a sectional view of the conductive kit of the electrical connector of the present disclosure.

Please refer to FIG. 3 to FIG. 5 together. The electrical conductive assembly 1 includes an insulation kit 10, a conductive assembly 11 and an electrical conductive member 12. Two ends of the insulation kit 10 are respectively defined as a plug end 10*a* and a wire end 10*b*, wherein an accommodating groove 101 is formed in the plug end 10*a* of the insulation kit 10. The insulation kit 10 has a separation portion 102 disposed in the accommodating groove 101. The separation portion 102 has a penetration hole 10*c* penetrating the insulation kit 10. Here, the insulation kit 10 may be a tubular structure, and the separation portion 102 may be a hollow columnar structure and substantially disposed on the central axis of the insulation kit 10. The separation portion 102 is provided to prevent the components disposed in the accommodating groove 101 from contacting with the components in the penetration hole 10*c*.

The conductive assembly 11 includes a conductive kit 111, a conductive retainer 112 and a flexible member 113. The conductive kit 111 is a hollow structure of which two ends are respectively formed as limiting parts 1111, 1111'. The conductive retainer 112 and flexible member 113 are disposed in the conductive kit 111. A positioning structure 1121 of the conductive retainer 112 is used to abut against the limiting part 1111 of the conductive kit 111, and at least one part of the conductive retainer 112 is selectively exposed outside the conductive kit 111. In practice, before the conductive retainer 112 and the flexible member 113 are disposed in the conductive kit 111, the conductive kit 111 only has the limiting part 1111', and when the conductive retainer 112 and the flexible member 113 are disposed in the conductive kit 111, the limiting part 1111 is formed on the conductive kit 111 corresponding to the conductive retainer 112 and the flexible member 113.

As shown in FIG. 4, two ends of the flexible member 113 disposed in the conductive kit 111 respectively abut against the limiting part 1111' of the conductive kit 111 and the positioning structure 1121 of the conductive retainer 112. When the conductive retainer 112 is compressed, the positioning structure 1121 of the conductive retainer 112 abuts against the flexible member 113 to enable the flexible member 113 to produce a restoring force. That is, when being compressed by an external member, the conductive retainer 112 is in contact with the external member more stably through the restoring force produced by the flexible member 113. When the positioning structure 1121 of the conductive retainer 112 abuts against the limiting part 1111 of the conductive kit 111, the flexible member 113 is in a compression action, thereby enabling the positioning structure 1121 of the conductive retainer 112 to stably abut against the limiting part 1111 of the conductive kit 111.

Figure 6:
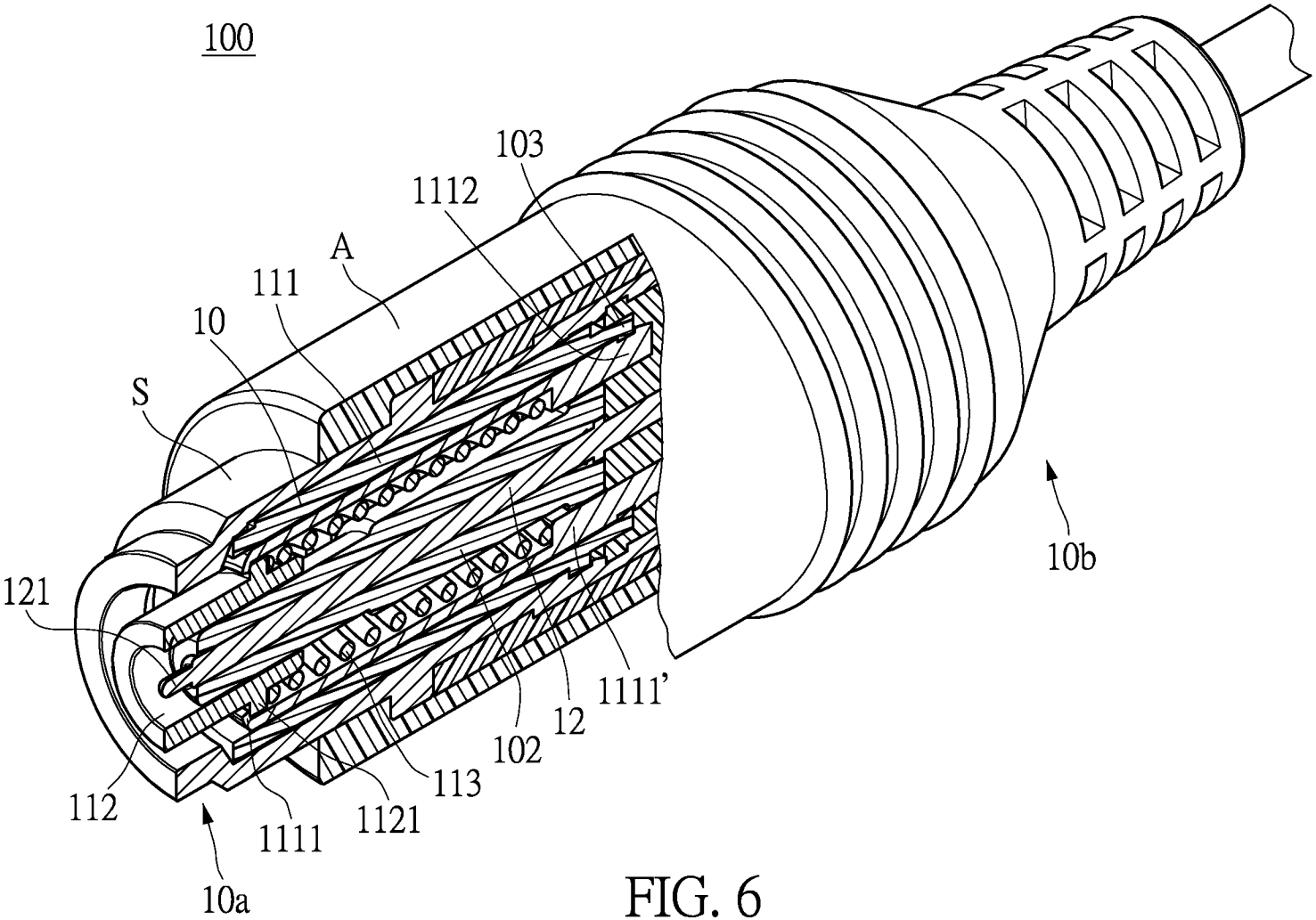
FIG. 6 is a three-dimensional sectional view of a part of the electrical connector of the present disclosure.

Please refer to FIG. 4 and FIG. 6 together. The conductive kit 111, the conductive retainer 112 and the flexible member 113 are all hollow structures, and a diameter of each of the conductive kit 111, the conductive retainer 112 and the flexible member 113 is larger than a diameter of the separation portion 102. The conductive assembly 11 sheathes the separation portion 102, that is, the separation portion 102 is disposed to respectively penetrate the hollow structures of the conductive kit 111, the conductive retainer 112 and the flexible member 113. When the separation portion 102 has been sheathed by the conductive kit 111, at least one part of the conductive retainer 112 is exposed outside the plug end 10*a*. In a preferred embodiment, the wire end 10*b* of the insulation kit 10 may have an engagement part 103, and the conductive kit 111 may have an engagement structure 1112 corresponding to the engagement part 103, so that the conductive assembly 11 and the separation portion 102 are fixedly connected with each other by engaging the engagement part 103 with the engagement structure 1112 when the conductive assembly 11 sheathes the separation portion 102, thereby increasing the connection strength therebetween.

The electrical conductive member 12 is disposed in the penetration hole 10*c* of the separation portion 102, and one end of the electrical conductive member 12 is exposed outside the plug end 10*a*, wherein the electrical conductive member 12 is separated from the conductive assembly 11 by the separation portion 102. Because the conductive assembly 11 and the electrical conductive member 12 are used to transmit different currents, the separation portion 102 is provided to prevent the conductive assembly 11 from contacting with the electrical conductive member 12 to effectively avoid having electrical contact.

As shown in FIG. 6, the electrical conductive member 12 has one end which is exposed outside the plug end 10*a*, wherein the distal end of the exposed end has a connection section 121 for electrically connecting to another electrical connector. In a preferred embodiment, the part of the conductive retainer 112 which is exposed outside the plug end 10*a* covers at least one part of the connection section 121, so that when the electrical conductive member 12 is connected with another electrical connector, the conductive retainer 112 is compressed by components of the electrical connector, and then the flexible member 113 is compressed by the positioning structure 1121 and the limiting part 1111' to produce the larger restoring force to enable the conductive retainer 112 to electrically connect with another electrical connector more stably.

Figure 7:
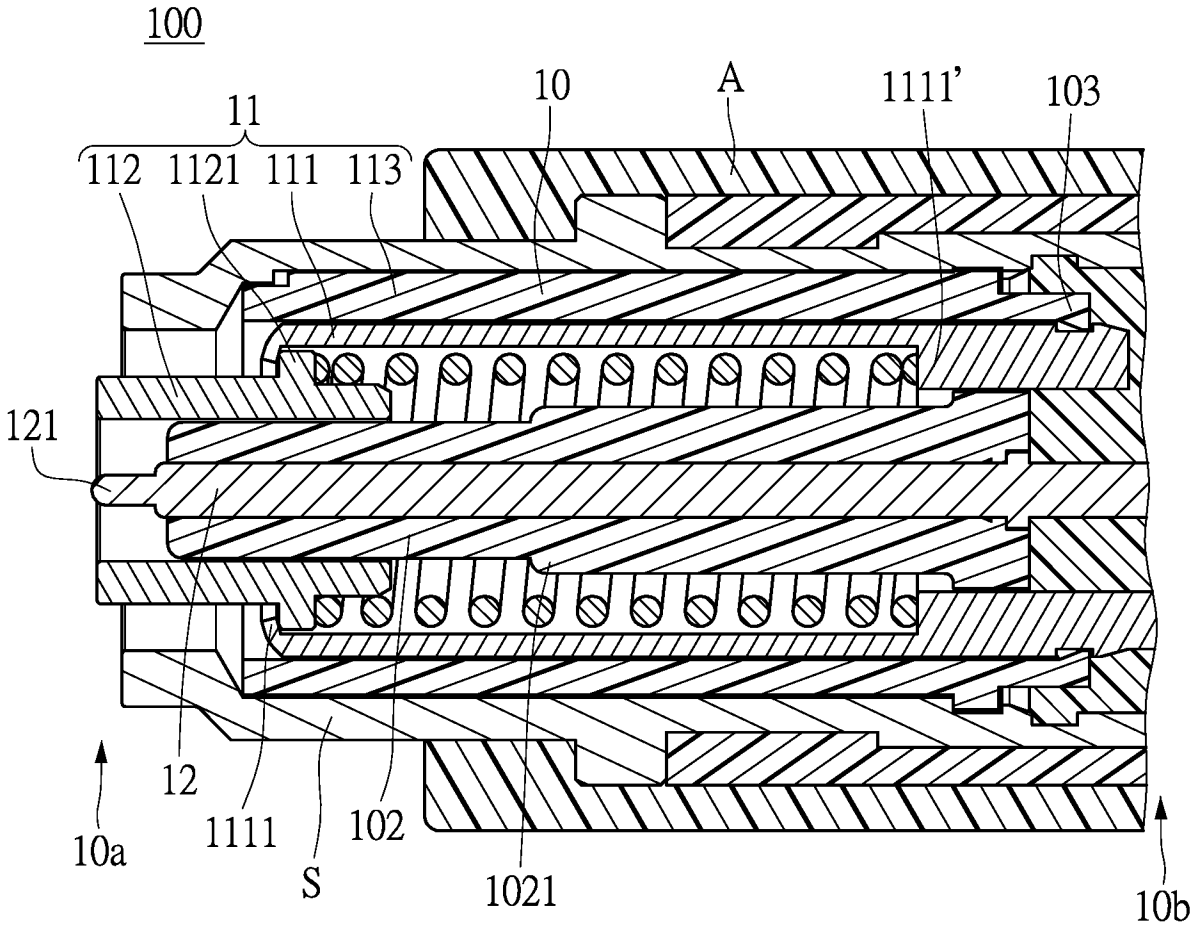
FIG. 7 is a sectional view of a part of the electrical connector of the present disclosure.

Please refer to FIG. 5 to FIG. 7. It is worth mentioning that in a preferred embodiment, the separation portion 102 has a confinement structure 1021 adjacent to the conductive retainer 112, and one end of the conductive retainer 112 corresponding to the conductive kit 111 abuts against the confinement structure 1021, so that when the conductive retainer 112 is compressed to move relative to the separation portion 102, the movement range of the conductive retainer 112 relative to the separation portion 102 is confined by the confinement structure 1021. To be precise, when the conductive retainer 112 is compressed by an excessive external force, one end of the conductive retainer 112 in the conductive kit 111 abuts against the confinement structure 1021 to prevent the conductive retainer 112 from continuously moving in the conductive kit 111, thereby effectively protecting the flexible member 113.

In conclusion, when the electrical connector of the present disclosure is connected to another electrical connector, the conductive retainer abuts against the flexible member to enable the flexible member to produce restoring force, and then the conductive retainer enables the electrical connector of the present disclosure to electrically connect to another electrical connector more stably because of the restoring force produced by the flexible member. In addition, the electrical connection strength therebetween is also increased.

The Second Embodiment

Figure 12:
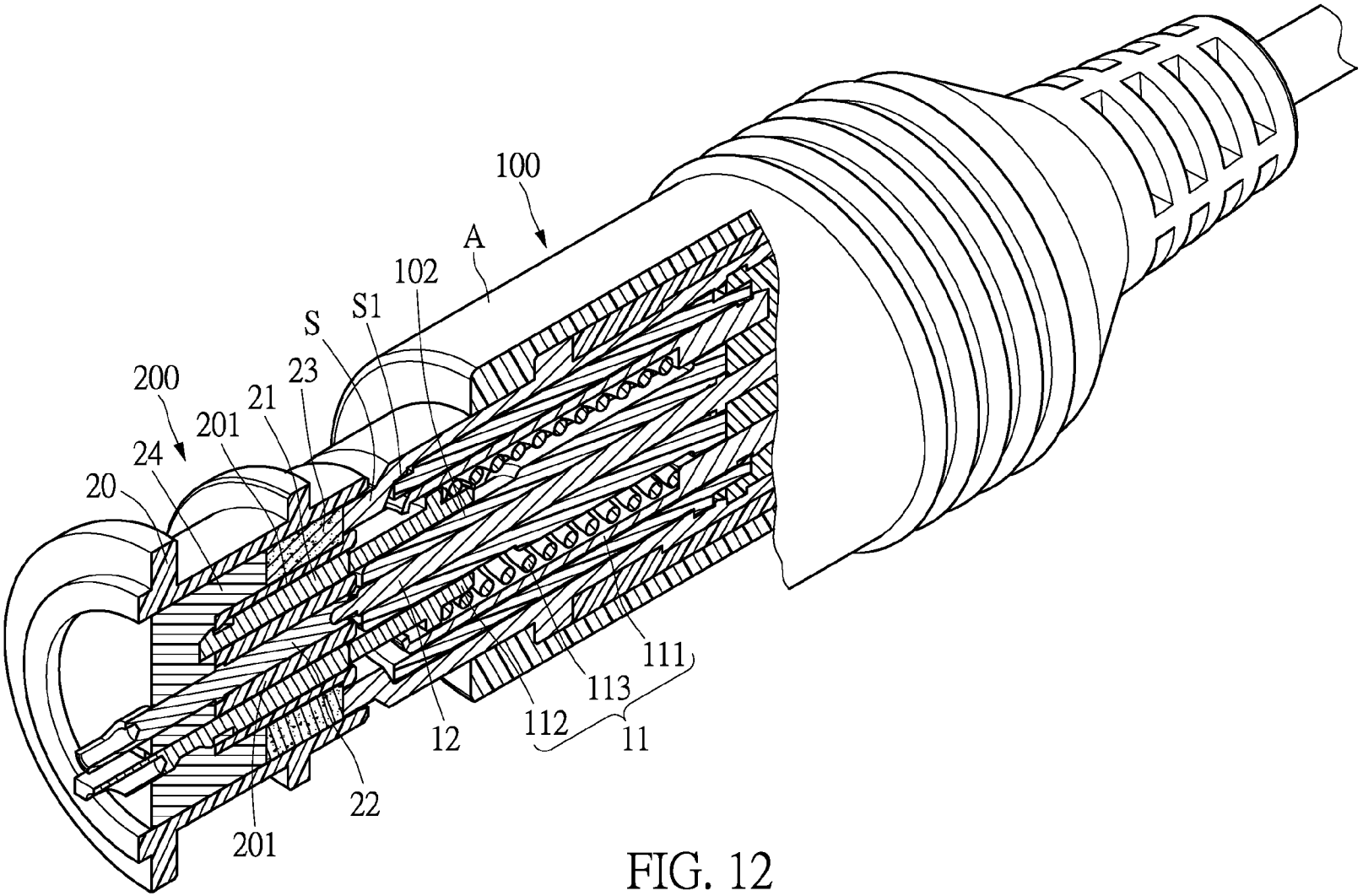
FIG. 12 and FIG. 13 are sectional views illustrating the electrical connection between the free end electrical connector and the fixed end electrical connector of the electrical connector assembly of the present disclosure.
Figure 13:
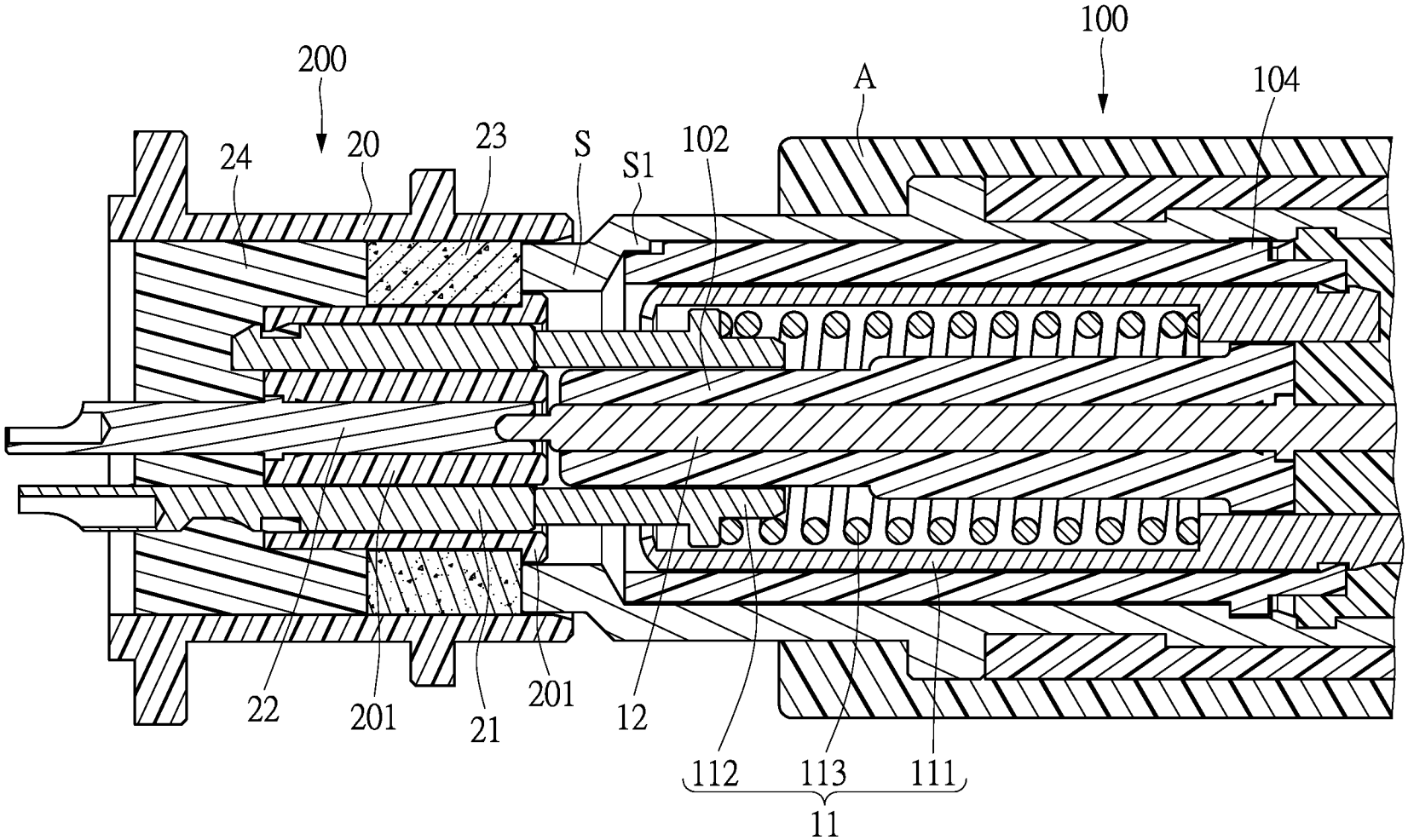

Please refer to FIG. 12 and FIG. 13. An electrical connector assembly of the present disclosure includes a free end electrical connector 100 and a fixed end electrical connector 200. The figures illustrate the connection of the free end electrical connector 100 and the fixed end electrical connector 200 of the electrical connector assembly of the present disclosure. The structures of the free end electrical connector 100 of the present disclosure are the same as the first embodiment, and the description thereof is not repeated. The following paragraphs detail the fixed end electrical connector 200 of the present disclosure and the related members and correlation thereof.

Figure 8:
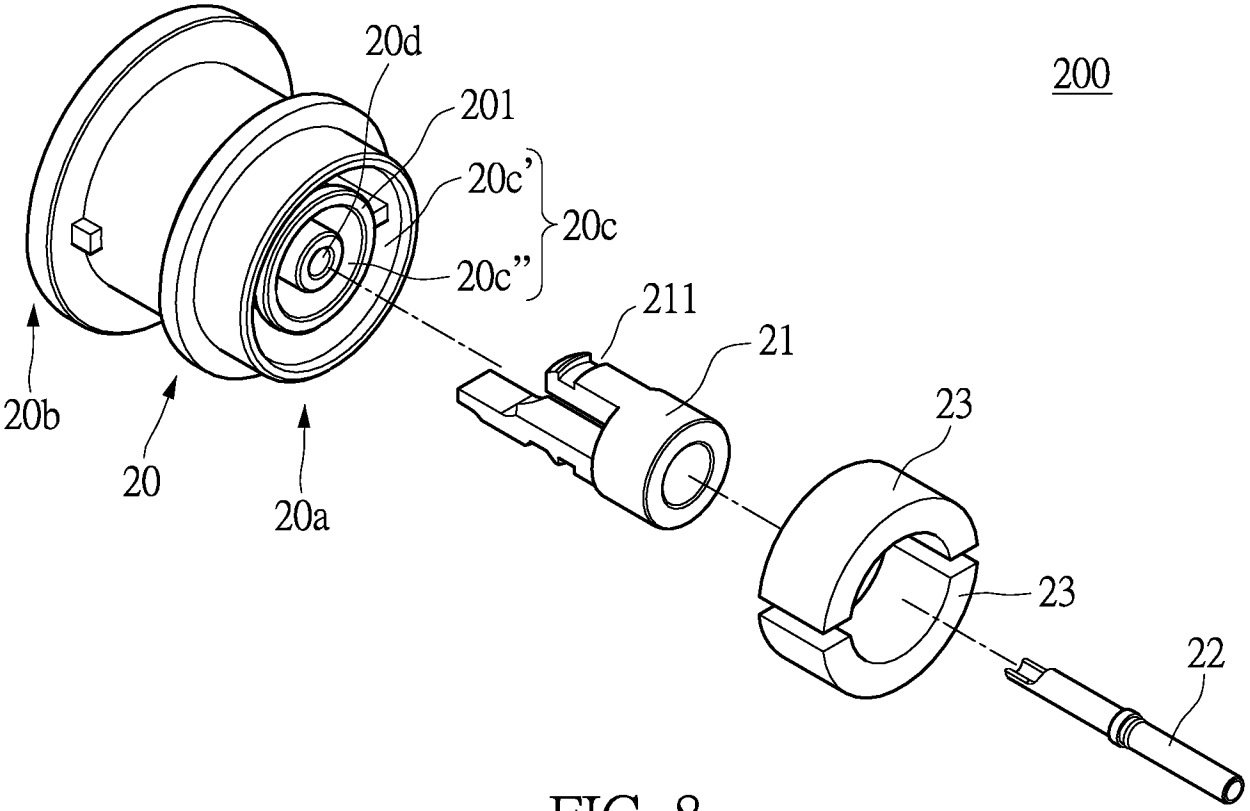
FIG. 8 is an exploded view of the fixed end electrical connector of the electrical connector assembly of the present disclosure.
Figure 10:
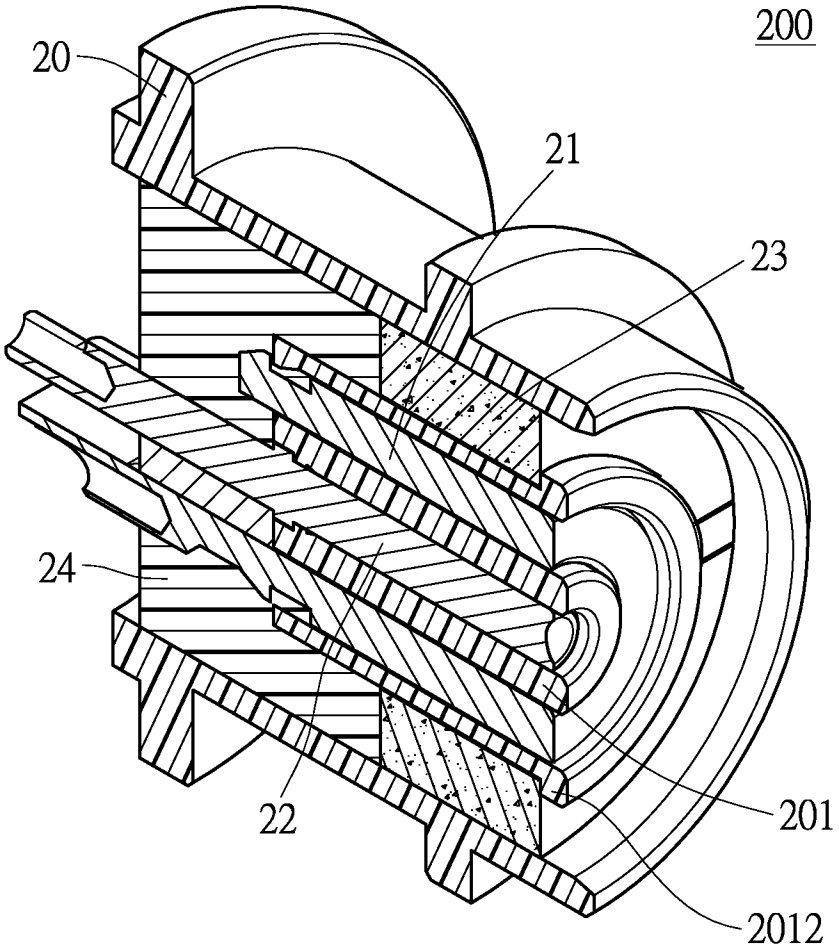
FIG. 10 is a three-dimensional section view of the fixed end electrical connector of the electrical connector assembly of the present disclosure.
Figure 11:
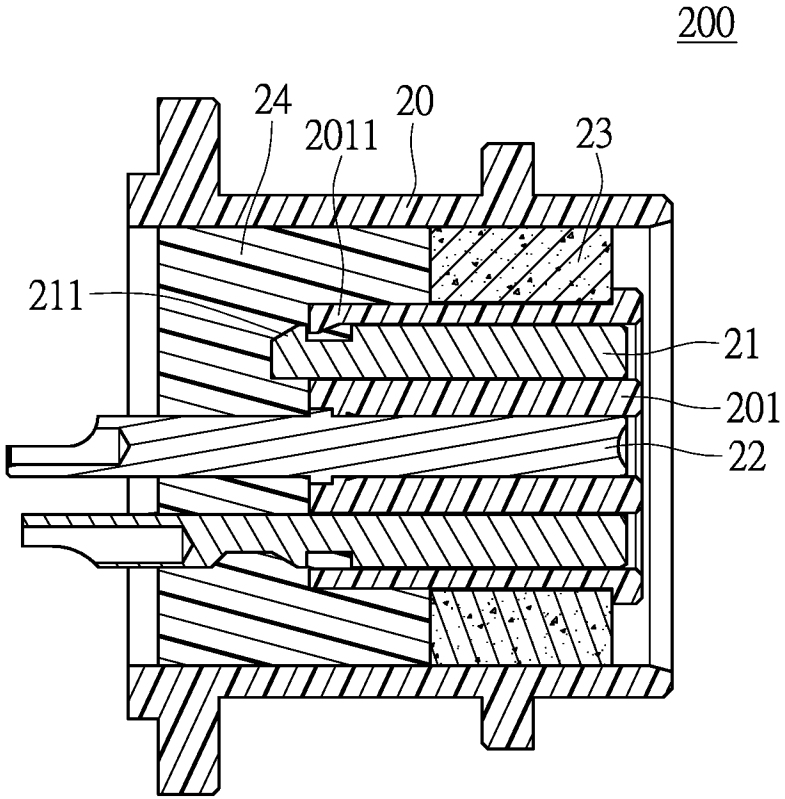
FIG. 11 is a sectional view of the fixed end electrical connector of the electrical connector assembly of the present disclosure.

Please refer to FIG. 8, FIG. 10 and FIG. 11 together. The fixed end electrical connector 200 includes a hollow insulation member 20, a conductive sleeving portion 21 and an electrical connection piece 22. Two ends of the hollow insulation member 20 are respectively defined as a connection end 20*a* and a fixed end 20*b*. An accommodating space 20*c* is formed in the hollow insulation member 20. The hollow insulation member 20 has a separation structure 201 disposed in the accommodating space 20*c*, and the separation structure 201 has a through hole 20*d* penetrating the hollow insulation member 20. Here, the hollow insulation member 20 may be a tubular structure, and the separation structure 201 may be a hollow columnar structure and substantially disposed on the central axis of the hollow insulation member 20. The separation structure 201 is provided to prevent the other components disposed in the hollow insulation member 20 from contacting with the components in the through hole 20*d*.

The separation structure 201 is sheathed by the conductive sleeving portion 21, and at least one part of the conductive sleeving portion 21 is exposed outside the connection end 20*a*. In a preferred embodiment, the separation structure 201 and the conductive sleeving portion 21 are respectively disposed with engagement structures 211, 2011, wherein the engagement structures 211, 2011 are capable of engaging with each other. By using the engagement structures 211, 2011, the conductive sleeving portion 21 can connect to the separation structure 201 more stably. The shape of the engagement structures of the present disclosure is not limited thereto, and can be made according to the actual requirements. The electrical connection piece 22 is disposed in the through hole 20*d*, and at least one part of the electrical connection piece 22 is exposed outside the connection end 20*a*. Because the conductive sleeving portion 21 and the electrical connection piece 22 are used to transmit different currents, the separation structure 201 is provided to prevent the conductive sleeving portion 21 from contacting with the electrical connection piece 22 to effectively avoid having electrical contact.

Please refer to FIG. 12 and FIG. 13 together. When the free end electrical connector 100 and the fixed end electrical connector 200 are electrically connected to each other, the conductive retainer 112 of the free end electrical connector 100 abuts against the conductive sleeving portion 21 of the fixed end electrical connector 200, and the electrical conductive member 12 of the free end electrical connector 100 abuts against the electrical connection piece 22 of the fixed end electrical connector 200. When the free end electrical connector 100 is connected to the fixed end electrical connector 200, the conductive retainer 112 of the free end electrical connector 100 is abutted by one end of the conductive sleeving portion 21 of the fixed end electrical connector 200, and the flexible member 113 of the free end electrical connector 100 is compressed to produce a restoring force, and then the conductive retainer 112 is connected to the conductive sleeving portion 21 more stably through the restoring force produced by the flexible member 113, thereby increasing the electrical connection strength therebetween.

Figure 9:
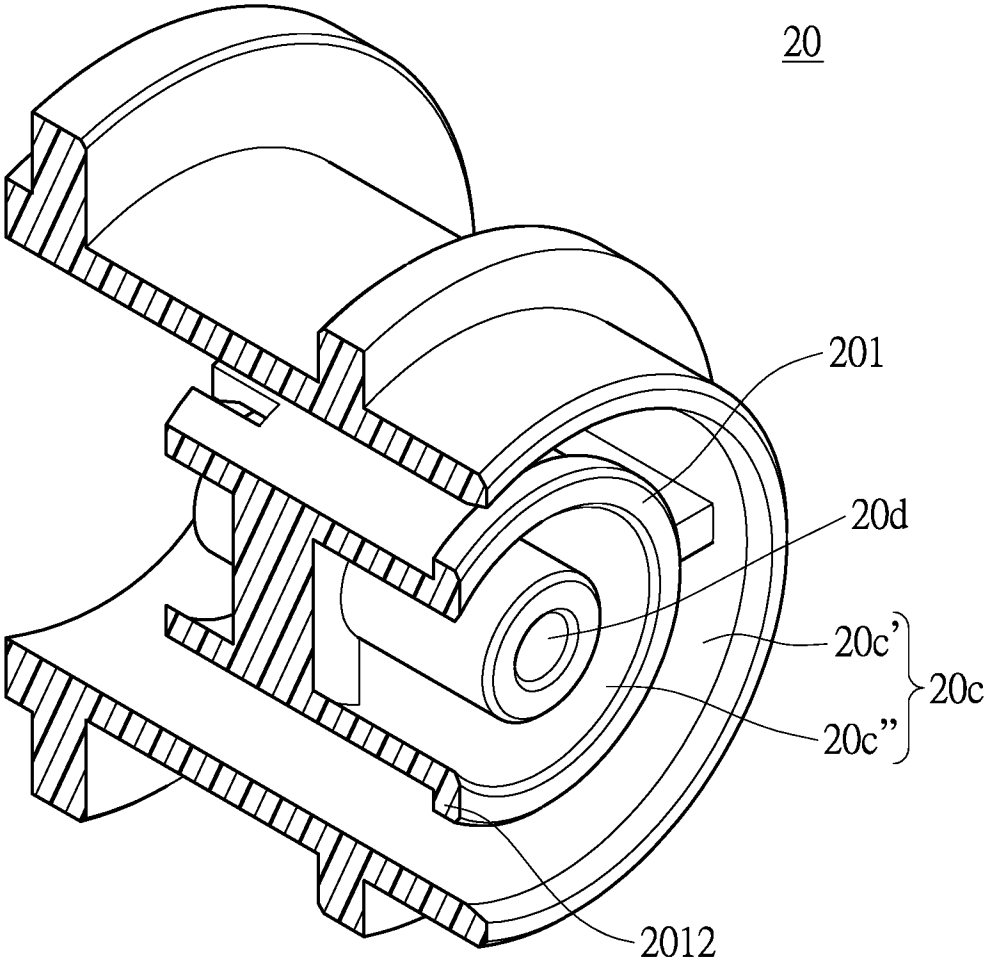
FIG. 9 is a sectional view of the hollow insulation member of the fixed end electrical connector of the electrical connector assembly of the present disclosure.

Please refer to FIG. 8 to FIG. 11 again. In a preferred embodiment, the fixed end electrical connector 200 includes at least one magnetic element 23, wherein there are two magnetic elements 23 used as an example in the present embodiment, but the present disclosure is not limited thereto. The magnetic element 23 is disposed in the hollow insulation member 20. As shown in FIG. 9, the separation structure 201 is used to divide the accommodating space 20*c* of the hollow insulation member 20 into an external accommodating space 20*c*' and an internal accommodating space 20*c*". The magnetic element 23 is disposed in the hollow insulation member 20 and corresponds to the external accommodating space 20*c*', and the conductive sleeving portion 21 is disposed in the internal accommodating space 20*c*". In order to stably dispose the magnetic element 23 in the external accommodating space 20*c*', one end of the separation structure 201 adjacent to the connection end 20*a* is disposed with a stop structure 2012 for stopping the magnetic element 23 from moving in the connection end 20*a*. In addition, the hollow insulation member 20 is disposed with a filled gel 24 therein to enable the magnetic element 23 to be disposed in the hollow insulation member 20 more stably. The free end electrical connector 100 may have a magnetic housing S covering an external portion of the insulation kit 10. In practice, an internal wall of the magnetic housing S and an external wall of the insulation kit 10 are disposed with fixed structures S1, 104 which can be fixed to each other to increase the connection strength therebetween. When the free end electrical connector 100 is connected to the fixed end electrical connector 200, the magnetic housing S of the free end electrical connector 100 is magnetically connected to the magnetic element 23 of the fixed end electrical connector 200 to increase the connection strength between two electrical connectors.

The above-mentioned descriptions represent merely the exemplary embodiment of the present disclosure, without any intention to limit the scope of the present disclosure thereto. Various equivalent changes, alterations or modifications based on the claims of present disclosure are all consequently viewed as being embraced by the scope of the present disclosure.

What is claimed is:

1. An electrical connector, comprising:

an insulation kit of which two ends are respectively defined as a plug end and a wire end, an accommodating groove formed in the plug end of the insulation kit, the insulation kit having a separation portion disposed in the accommodating groove, and the separation portion having a penetration hole penetrating the insulation kit;

a conductive assembly comprising a conductive kit, a conductive retainer and a flexible member, wherein the conductive kit is a hollow structure and two ends of the conductive kit are respectively disposed with a limiting part, the conductive retainer and the flexible member are disposed in the conductive kit, a positioning structure of the conductive retainer abuts against one of the limiting parts, a part of the conductive retainer is selectively exposed outside the conductive kit, and two ends of the flexible member respectively abut against the other of the limiting parts and the positioning structure, wherein the conductive assembly sheathes the insulation kit, the separation portion is disposed to respectively penetrate the conductive kit, the flexible member and the conductive retainer, and the conductive retainer is exposed outside the plug end; and an electrical conductive member disposed in the penetration hole, wherein one end of the electrical conductive member is exposed outside the plug end;

wherein when a part of the conductive retainer which is exposed outside the plug end is compressed, the positioning structure of the conductive retainer compresses the flexible member to enable the flexible member to produce a restoring force, and the restoring force is applied to the conductive retainer.

2. The electrical connector according to claim 1, wherein one end of the electrical conductive member which is exposed outside the plug end has a connection section used to electrically connect to another electrical connector, and the part of the conductive retainer which is exposed outside the plug end covers at least one part of the connection section.

3. The electrical connector according to claim 2, wherein a section of the separation portion adjacent to the conductive retainer is disposed with a confinement structure, and one end of the conductive retainer opposite to the other end which is exposed outside the conductive kit abuts against the confinement structure to confine a movement range of the conductive retainer relative to the separation portion.

4. The electrical connector according to claim 2, wherein the wire end of the insulation kit is disposed with an engagement part, the conductive kit is disposed with an engagement structure corresponding to the engagement part, and when the conductive assembly sheathes the separation portion, the engagement part and the engagement structure engage with each other.

5. An electrical connector assembly, comprising:

a free end electrical connector, comprising:

an insulation kit of which two ends are respectively defined as a plug end and a wire end, an accommodating groove formed in the plug end of the insulation kit, the insulation kit having a separation portion disposed in the accommodating groove, and the separation portion disposed with a penetration hole penetrating the insulation kit;

a conductive assembly comprising a conductive kit, a conductive retainer and a flexible member, wherein the conductive member is a hollow structure and two ends of the conductive member are respectively disposed with a limiting part, the conductive retainer and the flexible member are disposed in the conductive kit, a positioning structure of the conductive retainer abuts against one of the limiting parts, at least one part of the conductive retainer is selectively exposed outside the conductive kit, two ends of the flexible member respectively abut against the other of the limiting parts and the positioning structure, wherein the conductive assembly sheathes the insulation kit, the separation portion is disposed to respectively penetrate the conductive kit, the flexible member and the conductive retainer, and the conductive retainer is exposed outside the plug end, and an electrical conductive member disposed in the penetration hole, wherein one end of the electrical conductive member is exposed outside the plug end; and a fixed end electrical connector, comprising:

a hollow insulation member of which two ends are respectively defined as a connection end and a fixed end, an accommodating space formed in the hollow insulation member, wherein the hollow insulation member has a separation structure disposed in the accommodating space, and the separation structure has through hole penetrating the hollow insulation member;

a conductive sleeving portion sheathing the separation structure, wherein at least one part of the conductive sleeving portion is exposed outside the connection end, and an electrical connection piece disposed in the through hole, wherein at least one part of the electrical connection piece is exposed outside the connection end;

wherein when the free end electrical connector and the fixed end electrical connector are electrically connected to each other, the conductive retainer abuts against the conductive sleeving portion, the electrical conductive member abuts against the electrical connection piece, and the positioning structure of the conductive retainer compresses the flexible member to enable the flexible member to produce a restoring force, and then the restoring force is applied to the conductive retainer so as to enable the conductive retainer to electrically connect to the conductive kit more stably.

6. The electrical connector assembly according to claim 5, wherein the free end electrical connector further comprises a magnetic housing covering an external portion of the insulation kit, an internal wall of the magnetic housing and an external wall of the insulation kit are disposed with fixed structures which are fixed to each other, the hollow insulation member of the fixed end electrical connector is disposed with at least one magnetic element therein, the separation structure is provided to divide the accommodating space into an internal accommodating space and an external accommodating space, the conductive sleeving portion is disposed corresponding to the internal accommodating space, the magnetic element is fixedly disposed in the hollow insulation member and in the external accommodating space, and when the free end electrical connector is connected to the fixed end electrical connector, one end of the magnetic housing is magnetically connected to the magnetic element.

7. The electrical connector assembly according to claim 6, wherein a section of the separation portion adjacent to the conductive retainer is disposed with a confinement structure, and one end of the conductive retainer opposite to the other end which is exposed outside the conductive kit abuts against the confinement structure to confine a movement range of the conductive retainer relative to the separation portion.

8. The electrical connector assembly according to claim 6, wherein the wire end of the insulation kit is disposed with an engagement part, the conductive kit is disposed with an engagement structure corresponding to the engagement part, and when the conductive assembly sheathes the separation portion, the engagement part and the engagement structure engage with each other.

9. The electrical connector assembly according to claim 6, wherein the separation structure and the conductive sleeving portion are disposed with engagement structures which are able to engage with each other.

10. The electrical connector assembly according to claim 6, wherein the hollow insulation member of the fixed end electrical connector is disposed with a filled gel used to fixedly dispose the magnetic element in the hollow insulation member.

* * * * *